US007200954B2

(12) United States Patent
Watanabe et al.

(10) Patent No.: US 7,200,954 B2
(45) Date of Patent: Apr. 10, 2007

(54) METHOD FOR DRYING AND STORING ACTIVATED ALUMINUM FINE PARTICLES

(75) Inventors: Masao Watanabe, Shiraoi (JP); Ximeng Jiang, Chitose (JP); Ryuichi Saito, Chitose (JP)

(73) Assignees: Dynax Corporation, Chitose-shi (JP); Muroran Institute of Technology, Muroran-shi (JP)

( * ) Notice: Subject to any disclaimer, the term of this patent is extended or adjusted under 35 U.S.C. 154(b) by 95 days.

(21) Appl. No.: 11/209,192

(22) Filed: Aug. 20, 2005

(65) Prior Publication Data

US 2007/0000145 A1 Jan. 4, 2007

(30) Foreign Application Priority Data

Aug. 27, 2004 (JP) ..... 2004-248430

(51) Int. Cl.
*F26B 5/06* (2006.01)

(52) U.S. Cl. ..... 34/285; 423/658

(58) Field of Classification Search ..... 34/284, 34/285, 286, 288, 292, 298; 423/644, 658
See application file for complete search history.

(56) References Cited

U.S. PATENT DOCUMENTS 3,108,888 A * 10/1963 Bugosh ..... 501/95.1
5,004,710 A * 4/1991 Anderson ..... 501/103
6,223,455 B1 * 5/2001 Chickering et al. ..... 34/578
6,258,184 B1 7/2001 Iba et al.
6,634,576 B2 * 10/2003 Verhoff et al. ..... 241/21
6,811,602 B2 * 11/2004 Beppu et al. ..... 106/600
7,094,387 B2 * 8/2006 Zidan ..... 423/644
2006/0034756 A1 * 2/2006 Watanabe et al. ..... 423/657

FOREIGN PATENT DOCUMENTS

JP 335770/1999 12/1999
JP 2003-73765 3/2003

OTHER PUBLICATIONS

U.S. Appl. No. 11/197,782, filed Aug. 4, 2005, M. Watanabe et al.

* cited by examiner

*Primary Examiner*—S. Gravini
(74) *Attorney, Agent, or Firm*—Howson & Howson LLP

(57) ABSTRACT

The object is to provide a method for drying and storing activated aluminum fine particles which can be a hydrogen source for fuel cells for a long term without being deactivated. A thermal shock treatment as an activation of the aluminum fine particles, which repeats rapid heating and cooling, is performed to aluminum fine particles obtained by milling aluminum alloy; moisture contained in the activated aluminum fine particles is filtrated; said aluminum fine particles are pre-frozen; and the aluminum fine particles are freeze-dried and then stored in nitrogen atmosphere or vacuum-packed.

2 Claims, 1 Drawing Sheet

METHOD FOR DRYING AND STORING ACTIVATED ALUMINUM FINE PARTICLES

FIELD OF THE INVENTION

The present invention relates to a method for drying and storing activated aluminum fine particles. Activated aluminum fine particles react with water molecules and generate hydrogen gas. Generated hydrogen can be utilized as an energy source for a polymer electrolyte fuel cell (PEFC).

PRIOR ART

Hydrogen has attracted a great deal of public attention as a clean energy source which does not generate carbon dioxide even when it is combusted. While polymer electrolyte fuel cells, which use hydrogen as a fuel, have been enthusiastically developed, methods for producing and storing hydrogen to be supplied to these fuel cells have been developed in parallel.

An important technical problem, particularly for a portable-type miniature fuel cell, is to store and transport hydrogen safely and efficiently.

Conventionally, methods using a high-compression hydrogen and liquid hydrogen have been known as typical methods of storing hydrogen. In addition, a method utilizing hydrogen-occlusion alloy comprising alloys such as a Mg—Ni system, a La—Ni system and a Ti—Mn system, which can store hydrogen at high density under the moderate condition around normal pressure, is known. This method has been widely developed as an alternative method for storing hydrogen to a gas cylinder (by way of example, refer to Unexamined Japanese Patent Publication No. 335770/1999, which corresponds to U.S. Pat. No. 6,258,184, and to unexamined Japanese Patent Publication No. 2003-73765).

Since-a high pressure gas cylinder requires a container with a thick wall, which obviously causes heavy weight and low storage efficiency of the container, the high pressure gas cylinder cannot be made practicable for a portable-type miniature fuel cell. In addition, it is not appropriate from safety standpoint to carry around a gas cylinder filled with a large amount of hydrogen gas.

On the other hand, liquid hydrogen has better efficiency of transportation and storage in comparison with gaseous hydrogen. However, since it requires hydrogen with high purity for producing liquid hydrogen and liquefaction temperature as low as −253 degrees Celsius, a special container for ultra low temperature is required, which may result in high cost.

While hydrogen-occlusion alloy has more advantages in terms of safety, efficiency and low cost, in comparison with said gas cylinder and liquid hydrogen, it has a disadvantage that the alloy itself weighs heavy. Furthermore, light hydrogen-occlusion alloy of Mg system requires the operating temperature of at least 300 degrees Celsius, and therefore, it is not practically used as a fuel for a portable-type miniature fuel cell.

The inventors of the present invention have disclosed in Japanese Patent application 229172/2004, and in U.S. patent application Ser. No. 11/197,782, filed Aug. 4, 2005, a method for generating a large amount of hydrogen gas at room temperature by milling aluminum or aluminum alloy in water, activating the milled aluminum fine particles, and making the activated aluminum fine particles react with water molecules. If said activated aluminum fine particles can be stored without being deactivated for a long term, they can be a new source for fuel cells which operate at room temperature.

In view of the above problems, it is an object of the present invention to provide a method for storing activated aluminum fine particles, which can be a hydrogen source for fuel cells, for a long term without deactivating them.

SUMMARY OF THE INVENTION

The present invention solved the above-mentioned problems by providing a method for drying and storing activated aluminum particles, characterized in that a thermal shock treatment as an activation of said aluminum particles, comprising a step of heating aluminum particles obtained by milling aluminum or aluminum alloy materials from room temperature to a predetermined temperature with the temperature-rising speed range wherein microcracks and/or nanocracks are generated inside crystals of said aluminum particles and a step of cooling said aluminum particles down to a predetermined temperature with the temperature-falling speed range wherein microcracks and/or nanocracks are generated inside crystals of said aluminum particles, is repeated at least twice; and said activated aluminum particles are freeze-dried and then stored in nitrogen atmosphere or vacuum-packed.

According to the present invention, since activated aluminum particles can be stored without being deactivated for a long term, storage and transportation of the aluminum particles are facilitated, and therefore, it can supply hydrogen gas easily and safely to a portable-type miniature fuel cell.

DETAILED DESCRIPTION OF A PREFERRED EMBODIMENT

Figure 1:
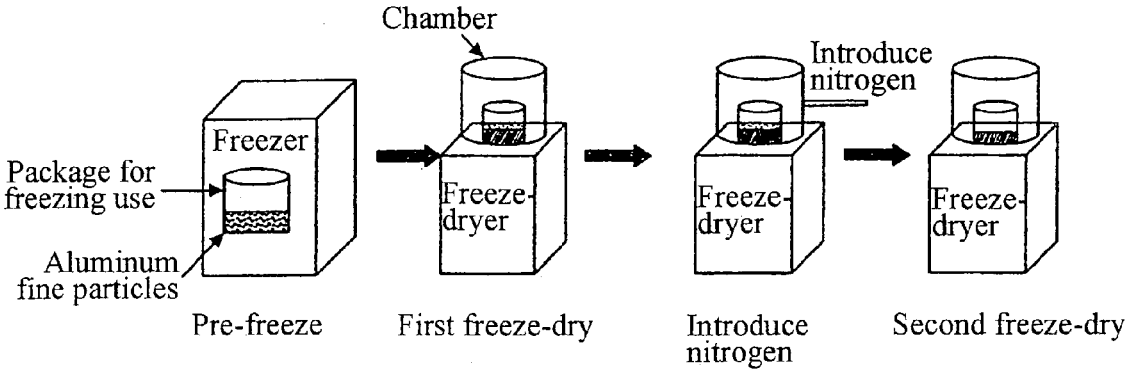
FIG. 1 is a schematic view showing the steps of freeze-drying activated aluminum fine particles.

The present invention will be explained in details below.

As described above, the inventors of the present invention have disclosed in Japanese Patent application 229172/2004, and in U.S. patent application Ser. No. 11/197,782, filed Aug. 4, 2005, a method for generating hydrogen gas at room temperature by activating aluminum fine particles obtained by milling aluminum or aluminum alloy in water and making the activated aluminum fine particles react with water molecules.

In the present invention, the activated aluminum fine particles are stored without being deactivated for a long term by storing in nitrogen atmosphere after freeze-drying activated aluminum fine particles.

In order to activate aluminum fine particles, a thermal shock treatment as an activation, comprising a step of heating aluminum fine particles obtained by milling aluminum or aluminum alloy materials from room temperature to a predetermined temperature at the temperature-rising speed range wherein microcracks and/or nanocracks are generated inside crystals of said aluminum particles and a step of cooling the aluminum fine particles down to a predetermined temperature with the temperature-falling speed range wherein microcracks and/or nanocracks are generated inside crystals of said aluminum particles, is repeated at least twice.

Since said activation method and a method for generating hydrogen at room temperature by making activated aluminum fine particles react with water molecules have been already disclosed in Japanese Patent application 229172/2004, and in U.S. patent application Ser. No. 11/197,782, only brief explanation of these methods will be given below.

First of all, chips of aluminum alloy are milled in the water, using a stone-mill-type mill, to produce aluminum alloy fine particles (the diameter of which are 5 to 50 micrometers respectively). After separating them according to their sizes using a sieve in the water, the aluminum fine particles are stored either in a refrigerator or a freezer set at 5 degrees Celsius or less. While milling said aluminum, micro/nano cracks are generated inside crystals of the aluminum fine particles (the diameter of which are 5 to 50 micrometers respectively) and are distributed throughout the fine particles. Water molecules go into the cracks that are generated, resulting in decomposition of water molecules and generation of aluminum hydride. Although the aluminum fine particles in this condition moderately generate hydrogen at the temperature around 20 degrees Celsius (at the speed of about 0.1 ml/min), it cannot be practically used.

Subsequently, by repeating rapid heating and cooling to the aluminum fine particles as described below, in other words, by conducting a "thermal shock treatment", distribution of micro/nano cracks within the aluminum fine particles can be dense.

A glass container holding the aluminum fine particles in water therein is moved onto a hot plate, and it is rapidly heated thereon. At this point, it is heated from room temperature to a pre-determined temperature with the temperature-rising speed range wherein microcracks are generated inside crystals of the aluminum fine particles. Preferably, the heating temperature at this time is in the range from 40 degrees Celsius to 80 degrees Celsius. Under this condition, the reaction of the aluminum fine particles with water is accelerated, and the generation of hydrogen gas becomes remarkable.

When the generation of hydrogen gas becomes intense, the aluminum fine particles together with the glass container is put in a freezer to cool them down rapidly. At this time, it is cooled down to a predetermined temperature with the temperature-falling speed range wherein microcracks and/or nanocracks are generated inside crystals of the aluminum fine particles. Preferably, the cooling temperature at this time is 10 degrees Celsius or less.

By repeating the above thermal treatment cycle of thermal shock treatment at least twice, $AlH_3$ and Al0 generated in cracks as alien substances of the aluminum crystals cause volume expansion, which generate another crack, and consequently, cracks spread throughout the aluminum fine particles. As a result, a large amount of hydrogen generation reaction can be realized at low temperature of 5 to 15 degrees Celsius.

The above-mentioned are a method for activating aluminum fine particles and a method for generating hydrogen at room temperature by making activated aluminum fine particles react with water molecules.

The present invention realized to maintain activated condition of aluminum fine particles for a long term by storing them in nitrogen atmosphere or vacuum-packed after drying the aluminum fine particles activated by above-mentioned method by freeze-drying method.

Conventionally, freeze-drying method has been used as a method for storing biochemical materials such as blood serum without losing their biological activity. In comparison with other drying methods, freeze-drying method has an advantage that it does not damage unstable substances nor generate chemical reaction.

FIG. 1 is a schematic view showing the steps of freeze-drying activated aluminum fine particles. As a preparation before freeze-drying, the aluminum fine particles are pre-frozen by the following steps.

Firstly, moisture contained in the aluminum fine particles, which are stored in water in the container in a refrigerator, is filtrated using means such as a membrane filter or a paper filter. When the mass of said moisture water reaches 20% or less, the aluminum fine particles are immediately put in a freezer to be rapidly frozen down to the temperature of at least 0 degree Celsius. Subsequently, it is preferable to put and seal the aluminum fine particles in a package for freezing use in order to avoid oxidation of the aluminum fine particles. However, when there is a large amount of aluminum fine particles, other containers such as a sealable tray for a freeze-dryer may be used instead of a package for freezing use.

After being pre-frozen, the first freeze-drying is conducted by the following steps.

Firstly, a container holding frozen aluminum fine particles is put in a freeze-drying bottle or a chamber of a freeze-dryer. When a package for freezing use is used as a container, the package is opened and put inside. In order to shorten drying time or to improve drying efficiency, the surface area of entire frozen aluminum fine particles is enlarged as much as possible.

The freeze-dryer is set to be in dryable condition, and air is evacuated from the freeze-dryer.

By freeze-drying the aluminum fine particles using the freeze-dryer, the aluminum fine particles are dried while being frozen at the temperature of at least −20 degrees Celsius. Freeze-drying time depends on the amount of the aluminum fine particles. For example, when 4.5 g of the aluminum fine particles are used, it takes about 4 hours.

When there is a large amount of aluminum fine particles, drying time can be shortened by providing a heater within the freeze-dryer, which allows to freeze-dry the aluminum fine particles while heating. Drying the aluminum particles while heating with a heater provided within the freeze-dryer is effective in having the moisture contained within the aluminum fine particles move to the surface.

Subsequently, in order to avoid generation of oxide on the surface of the particles, nitrogen is introduced into the freeze-drying bottle or the chamber, and it is closed in nitrogen atmosphere.

When the amount of the aluminum fine particles is about 500 g, 80% of water contained in the fine particles and on the surface of the fine particles is sublimated by conducting the above-mentioned first freeze-drying.

When there is a small amount of the aluminum fine particles, or when the surface drying area of the aluminum fine particles is big enough, the aluminum fine particles can be dried up to the inside by conducting only the above first freeze-drying, and can be reduced to powder.

When there is a large amount of the aluminum fine particles, in addition to the above method wherein the aluminum fine particles are heated with a heater, the second freeze-drying can be conducted to remove moisture inside the aluminum fine particles.

Before conducting the second freeze-drying, the aluminum fine particles, which are frozen at the temperature of 20 degrees Celsius or less, are thawed out to room temperature. By thawing out the aluminum fine particles to room temperature, residual moisture (bound water) inside the fine particles is thawed out and the water inside the aluminum fine particles moves to the surface.

Thawing out to room temperature is conducted by introducing nitrogen into a freeze-dryer.

After thawing out the aluminum fine particles to room temperature, the second freeze-drying is performed following the same steps of the above freeze-drying. By performing the second freeze-drying, bound water remaining inside the aluminum fine particles is removed, and thus dryness of the aluminum fine particles can be improved.

After completing the first and second freeze-drying, a valve separating the freeze-dryer and a vacuum pump are closed. Nitrogen is introduced into the chamber or the freeze-drying bottle, and the container holding the aluminum fine particles is closed in the nitrogen atmosphere.

The container holding the aluminum fine particles is taken out of the chamber or the freeze-drying bottle. Nitrogen is put into a nitrogen box beforehand.

Dried aluminum fine particles together with the container are put into the nitrogen box, and the aluminum fine particles are stored inside the nitrogen box for a long term. When a tray is used as a container, it is stored after being changed to other storage container inside the nitrogen box.

In this connection, as a method for storing the aluminum fine particles, in addition to the above method wherein the aluminum fine particles are stored in the nitrogen atmosphere, the aluminum fine particles can be vacuum-packed and stored using a vacuum-packing apparatus.

The present invention will be explained in details by the following examples. It should be noted that the present invention is not to be limited to these examples.

EXAMPLES 4.5 g of aluminum fine particles were activated, freeze-dried, and stored by the following methods.

In order to activate the aluminum fine particles, a thermal shock treatment as an activation, comprising a step of heating the aluminum fine particles to 60 degrees Celsius at the temperature-rising speed of 3–6 degrees Celsius per minute and a step of cooling them down to −5 degrees Celsius at the temperature-falling speed of 10 degrees Celsius per minute, was repeated four times.

After filtrating water contained in the activated aluminum fine particles using a membrane filter, the aluminum fine particles were rapidly frozen and were put into a package for freezing use. (Pre-freezing)

The package was opened and put inside a chamber of a freeze-dryer, and the aluminum fine particles were freeze-dried for 4 hours while being frozen at the temperature of −20 degrees Celsius. (First freeze-drying)

Nitrogen was introduced into the freeze-dryer with 100 cc/min of flow rate, and the introduction of nitrogen was stopped when the pressure inside the freeze-dryer reached 1 atmospheric pressure. After thawing out the aluminum fine particles to room temperature, 4 hours of freeze-drying was performed again. (Second freeze-drying)

After completing the first and second freeze-drying, nitrogen was introduced into the chamber, the package was closed in the nitrogen atmosphere, and the package was moved from the freeze-dryer to the box filled with nitrogen so to be stored.

Figure 2:
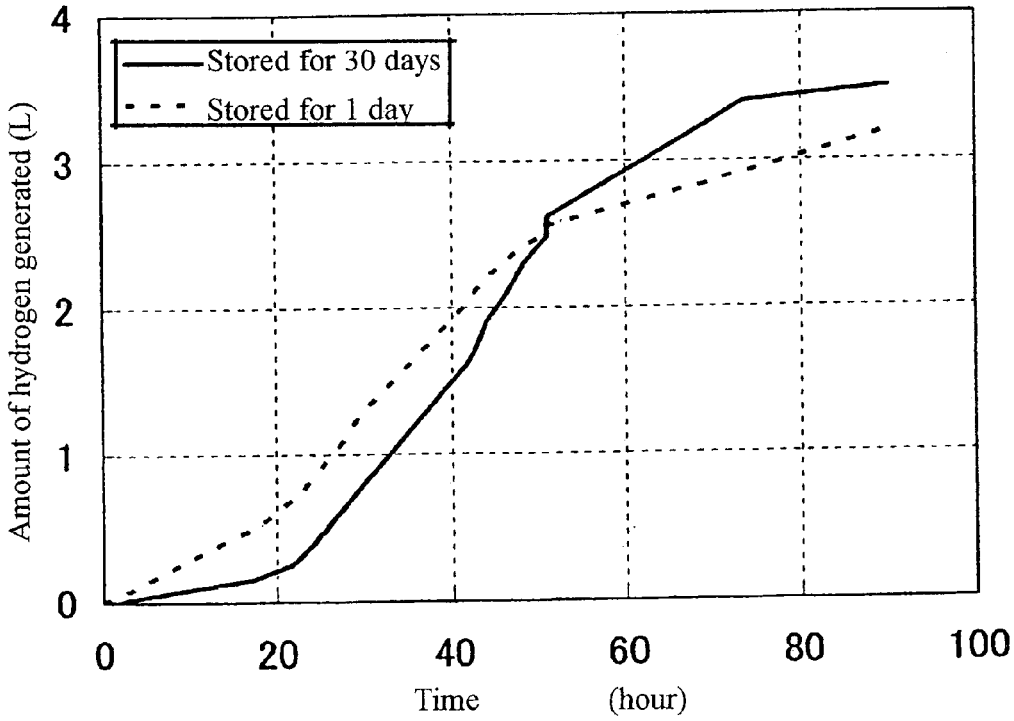
FIG. 2 is a view showing hydrogen generation property of 4.5 g of activated aluminum fine particles measured each days during being stored.

Hydrogen generation property at the temperature of 20 degrees Celsius of the aluminum fine particles obtained by the above method is shown in FIG. 2. In FIG. 2, a broken line shows the amount of hydrogen generated after storing the aluminum fine particles for one day, and a solid line shows the amount of hydrogen generated after storing the aluminum fine particles for 30 days.

By comparing both results, it is apparent that both the speed and the amount of hydrogen generated do not change and the aluminum fine particles maintain its function to generate a large amount of hydrogen generated even after storing them for 1 months or more.

As described above, according to the present invention, since activated-aluminum fine particles are freeze-dried and stored in the nitrogen atmosphere or vacuum-packed, the activated condition of the aluminum fine particles can be maintained for a long term. According to the present invention, the storage and transportation of the aluminum fine particles can be facilitated, and therefore, hydrogen gas can be supplied easily and safely to a portable-type miniature fuel cell.

The invention claimed is:

1. A method for drying and storing activated aluminum particles, characterized in that a thermal shock treatment as an activation of said aluminum particles, comprising a step of heating aluminum particles obtained by milling aluminum or aluminum alloy materials from room temperature to a predetermined temperature with the temperature-rising speed range wherein microcracks and/or nanocracks are generated inside crystals of said aluminum particles and a step of cooling said aluminum particles down to a predetermined temperature with the temperature-falling speed range wherein microcracks and/or nanocracks are generated inside crystals of said aluminum particles, is repeated at least twice; and said activated aluminum particles are freeze-dried and then stored in nitrogen atmosphere or vacuum-packed.

2. A method for drying and storing activated aluminum particles, characterized in that a thermal shock treatment as an activation of said aluminum particles, comprising a step of heating aluminum particles obtained by milling aluminum or aluminum alloy materials from room temperature to a predetermined temperature with the temperature-rising speed range wherein microcracks and/or nanocracks are generated inside crystals of said aluminum particles and a step of cooling said aluminum particles down to a predetermined temperature with the temperature-falling speed range wherein microcracks and/or nanocracks are generated inside crystals of said aluminum particles, is repeated at least twice;

moisture contained in said activated aluminum particles is filtrated and subsequently, said aluminum particles are frozen;

said aluminum particles are freeze-dried;

said aluminum particles frozen by said freeze-drying are thawed out to room temperature;

said aluminum particles are freeze-dried again; and said aluminum particles are stored in nitrogen atmosphere or vacuum-packed.

* * * * *

UNITED STATES PATENT AND TRADEMARK OFFICE

CERTIFICATE OF CORRECTION

PATENT NO. : 7,200,954 B2
APPLICATION NO. : 11/209192
DATED : April 10, 2007
INVENTOR(S) : Masao Watanabe et al.

It is certified that error appears in the above-identified patent and that said Letters Patent is hereby corrected as shown below:

On the Title Page, at (22) "Filed: Aug. 20, 2005" should read --Filed: Aug. 22, 2005--;
Column 1, line 37, "Since-a" should read --Since a--;
Column 6, line 15, "activated-aluminum" should read --activated aluminum--.

Signed and Sealed this

Third Day of July, 2007

JON W. DUDAS
*Director of the United States Patent and Trademark Office*